US006731318B2

(12) United States Patent
Aigner et al.

(10) Patent No.: US 6,731,318 B2
(45) Date of Patent: May 4, 2004

(54) METHOD FOR CONTROLLING THE HEATING ELEMENTS OF A THERMAL PRINT HEAD

(75) Inventors: Roland Aigner, Hallein-Rif (AT); Walter Lechner, Wals (AT)

(73) Assignee: Skidata AG, Gartenau (AT)

( * ) Notice: Subject to any disclaimer, the term of this patent is extended or adjusted under 35 U.S.C. 154(b) by 0 days.

(21) Appl. No.: 10/030,006

(22) PCT Filed: Mar. 7, 2001

(86) PCT No.: PCT/EP01/02568

§ 371 (c)(1),
(2), (4) Date: Oct. 25, 2001

(87) PCT Pub. No.: WO01/68370

PCT Pub. Date: Sep. 20, 2001

(65) Prior Publication Data

US 2003/0007059 A1 Jan. 9, 2003

(30) Foreign Application Priority Data

Mar. 14, 2000 (DE) ..... 100 12 360

(51) Int. Cl.[7] ..... B41J 2/35
(52) U.S. Cl. ..... 347/211
(58) Field of Search ..... 347/211, 183, 347/184, 186, 188, 195, 25, 82, 19, 194; 358/296; 503/201; 400/120.08, 120.01

(56) References Cited

U.S. PATENT DOCUMENTS

| | | | | | |
|---|---|---|---|---|---|
| 4,870,428 | A | * | 9/1989 | Kuwabara et al. | 347/195 |
| 5,158,924 | A | * | 10/1992 | Konagaya et al. | 280/770 |
| 5,231,505 | A | * | 7/1993 | Watanabe et al. | 358/296 |
| 5,235,345 | A | * | 8/1993 | Ohno et al. | 347/211 |
| 5,391,872 | A | | 2/1995 | Itoh et al. | 250/316.1 |
| 5,424,764 | A | | 6/1995 | Yamaguchi et al. | 347/179 |
| 5,555,010 | A | | 9/1996 | Ohno et al. | 347/211 |
| 5,900,900 | A | | 5/1999 | Hotta et al. | 503/201 |
| 6,254,225 | B1 | * | 7/2001 | Chwalek et al. | 347/82 |

FOREIGN PATENT DOCUMENTS

| | | |
|---|---|---|
| DE | 42 00 474 | 7/1995 |

* cited by examiner

*Primary Examiner*—Lamson Nguyen
*Assistant Examiner*—K. Feggins
(74) *Attorney, Agent, or Firm*—Flynn, Thiel, Boutell & Tanis, P.C.

(57) ABSTRACT

For recording and erasure of data on a reversibly writable thermal recording material (5) with a thermal print head (2), the heating elements (8) of the thermal print head for recording are subjected to an energy pulse (W) which causes the recording material to be heated to a temperature (T1) at which it assumes a colored and/or opaque state. For erasure subsequent to the recording pulse (W), the heating elements (8) are subjected to an energy pulse train (E1).

20 Claims, 3 Drawing Sheets

METHOD FOR CONTROLLING THE HEATING ELEMENTS OF A THERMAL PRINT HEAD

FIELD OF THE INVENTION

This invention relates to a method for controlling the heating elements of a thermal print head for recording and erasing dots with a reversibly writable thermal recording material.

BACKGROUND OF THE INVENTION

A reversibly writable thermal recording material is characterized in that its transparency and/or color can change reversibly from a transparent and/or colorless state to an opaque and/or colored state and vice versa in dependence on temperature.

The reversibly writable thermal recording material is supplied step-by-step to the thermal print head. The print head has a row of individually drivable resistance heating elements extending over the total printing width transversely to the transport direction of the thermal recording material. In each print step one can record a line of dots corresponding to the row of heating elements if the heating elements are heated to a temperature leading to the colored/opaque state of the thermal recording material.

Erasure of the colored/opaque dots can be effected by a second thermal print head whose heating elements are heated to a temperature at which the reversibly writable thermal recording material changes back to the colorless/transparent state. One can also use a single thermal print head which erases when the recording material is moved along it in one direction, and records, i.e. writes dots, upon subsequent movement of the recording material in the reverse direction (DE 41 30 539 A1).

German Patent Document No. DE 42 10 379 C2 discloses first applying an energy pulse train to drive the heating elements that are to record a dot and then applying another energy pulse train to the heating elements that are to perform dot-by-dot erasure, in each transport cycle.

In known reversible recording methods, however, the recording speed leaves something to be desired.

SUMMARY OF THE INVENTION

The object of the invention is to substantially increase the recording and erase speed in thermal printing of a reversibly writable recording material.

According to the invention, the heating elements are driven for writing with a single energy pulse leading to a temperature at which the reversibly writable thermal recording material assumes a first, high temperature leading to the colored/opaque state.

The heating elements which are to perform erasure are then subjected to an energy pulse train when the maximum temperature has been reached after the recording pulse. This permits the processing, i.e. recording and erasure of the individual dots of a printed line, to be reduced to 3 milliseconds or less and an accordingly high recording and erase speed to be reached.

According to the invention, one uses a reversibly writable thermal recording material that becomes colored and/or opaque at the first, high temperature and retains the colored/opaque state upon rapid cooling. However, upon slow cooling, the colored/opaque state of this thermal recording material is lost if constant heating to a second lower temperature takes place.

The first high temperature that makes the thermal recording material become colored or opaque, i.e. milky, may be 150° C. or more for example. The second lower temperature to be held constant leading to erasure is preferably at least 20° C. lower.

Therefore, the heating elements can be subjected to the energy pulse train for erasure in two versions according to the invention.

According to one variation, all heating elements are first driven with the recording energy pulse and, subsequent to the recording energy pulse, an energy pulse train is supplied that slows down the cooling of those heating elements which are to bring about erasure such that the recording material assumes its colorless/transparent state. In this version, all heating elements are thus in each cycle first heated to the temperature necessary for coloring the recording material and the heating elements that are to erase dot-by-dot are then subjected to the pulse train in order to cool more slowly than the other heating elements. One need not necessarily drive all heating elements of the thermal print head in this fashion, but only those which correspond to the desired printing width. The colorless/transparent state might also have a different color from the one appearing upon coloring of the thermal recording material.

According to the second version of the invention, the heating elements for recording are subjected to the recording energy pulse and the heating elements for erasure, directly subsequent to the recording energy pulse, to an energy pulse train which heats the heating elements to a second temperature to be held constant at which the thermal recording material assumes a transparent/colorless state, the second temperature being below the temperature producing the colored/opaque state.

In the second version, however, the second temperature must in general be held for a certain time of at least 1 millisecond for erasure. It is therefore in general somewhat slower than the first variant. That is, the pulse duration for the recording pulse is approximately 1 to 2 milliseconds. Whereas, the duration of the pulse train supplied during cooling in the first variant is approximately 1 to 2 milliseconds, the duration of the pulse train for erasure in the second variant is approximately 2 to 3 milliseconds in order to hold the temperature for at least approximately 1 millisecond at the second temperature at which the thermal recording material assumes the transparent/colorless state.

The reversibly writable thermal recording material that can be used according to the invention may be any known reversibly writable thermal recording material (compare DE 41 30 539 A1, DE 42 10 379 C2 and 42 00 474 C2). However, one preferably uses a recording dialkylamine residue at the 3 position and at its 9 position a phenyl residue is bound with a carboxyl acid group at the ortho position so that, as in fluorescein, a lactone ring forms with the 9 position in the leuco form, said ring being open in the colored state through re-formation of the carboxyl group. As a developer, one can use an acid amide of carboxylic acid with a para-aminophenol and/or a urea derivative substituted with a para-hydroxyphenyl residue on an amino group and with an alkyl residue on the other amino group.

The energy supply for erasure in the form of a pulse train obtains fine temperature control according to the invention. For this purpose, the pulse train has pulses with the same period of preferably less than 100 microseconds, in particular less as 50 microseconds. The pulse/pause ratio per period is preferably at most 1:1, a maximum on duty cycle of 50%, in particular approximately 1:2, an on duty cycle of 33%. That is, at a period of e.g. 30 microseconds the pulse duration is 10 microseconds and the pause 20 microseconds for example.

Preferably, the heating elements of the thermal print head are preheated before processing, i.e. recording and erasure, to a temperature that is preferably at least 30° C. below the second, i.e. erase, temperature. If the erase temperature is 120° C. for example, the preheating temperature can be approximately 60° C. for example.

Such preheating in thermal printing is indicated for example by DE 30 33 746 A1. Preheating lowers the temperature difference until recording or erasure, i.e. reduces the heating capacity necessary for printing, Such preheating in thermal printing is indicated for example by DE 30 33 746 A1. Preheating lowers the temperature difference until recording or erasure, i.e. reduces the heating capacity necessary for printing, thereby achieving a higher printing speed due to the faster heating of the resistance heating elements. Moreover, the erase quality is clearly improved.

While, according to DE 38 33 746 A1, the clock frequency during preheating should be no more than the quadruple of the pulse duration for recording and the pulse width during preheating should be constant, according to the invention the period of the single pulses of the pulse train for preheating is less than 100 microseconds, in particular less than 50 microseconds, i.e. less than one tenth, preferably less than one twentieth, of the pulse duration at a pulse duration for the recording pulse of 1 to 2 milliseconds.

In order to permit the desired preheating temperature to be adjusted as exactly as possible, the pulse/pause ratio per period, the on duty cycle, is furthermore preferably reduced with increasing temperature of the thermal print head. Thus, at a constant period of the single pulses, the pulse duration can be for example 10% or less of the period at the beginning of preheating, and for example 3% or less at the end of the preheating process or for holding the preheating temperature. That is, at a period of for example 30 microseconds per single pulse, the pulse duration can be for example 2 microseconds at the beginning of preheating and for example 0.5 microseconds at the end of preheating and for holding the preheating temperature.

The pulse duration during preheating can be controlled for example by the temperature of the thermal print head, which can be measured with a temperature sensor, for example a temperature-dependent resistor with a negative temperature coefficient.

Under these circumstances, the preheating temperature of the heating elements can be adjusted to for example ±2° C. or even more exactly. The thermal print head is thus minimally stressed thermally and its life essentially increased. As experiments indicate, this even makes the life longer than without preheating since the thermal print head is subject to smaller temperature jumps during recording. The period of the single pulses of the pulse train during preheating preferably corresponds to the period of the single pulses of the pulse train for erasure, being for example 30 microseconds in both cases.

BRIEF DESCRIPTION OF THE DRAWINGS

In the following, the invention will be explained in more detail by way of example with reference to the drawings, in which.

DETAILED DESCRIPTION

Figure 1:
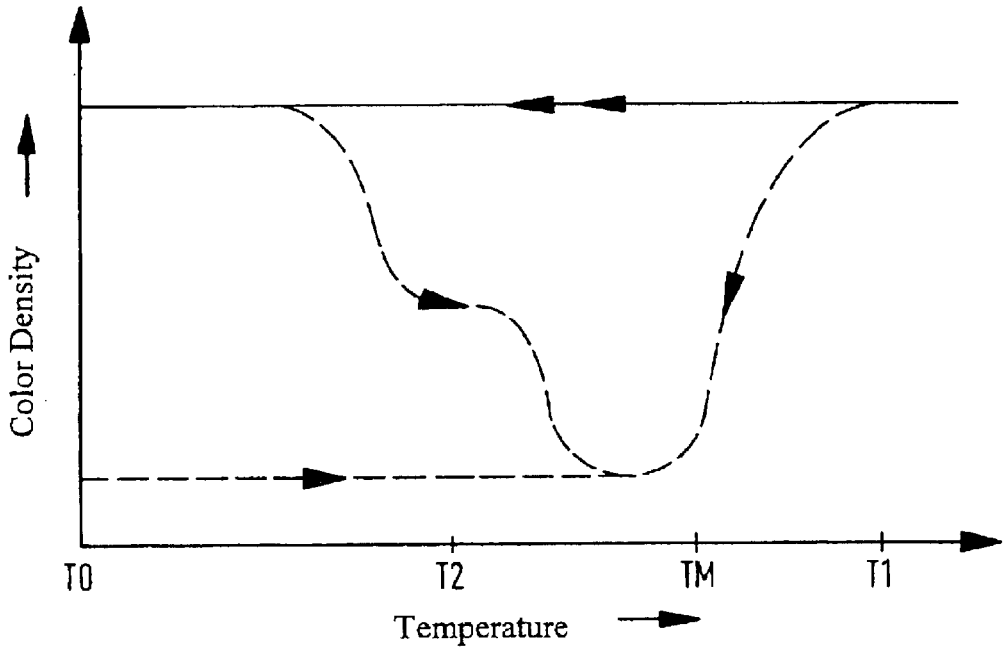
FIG. 1 shows a diagram representing the change in color density of a reversible heat-sensitive recording material for use in the inventive method in dependence on temperature.

According to FIG. 1, the reversible thermal recording material exists at T0 in a transparent and/or colorless state, i.e. with low color density. T0 may be room temperature or lower, or be a preheating temperature. Heating from T0 to T1 (e.g. 160° C.) causes the color density to increase according to the dashed line, in particular after melting point TM of the reversible thermal dye has been exceeded. While the colored and/or opaque state is retained when rapid cooling takes place from T1 according to the solid line. Alternatively, the material returns to the colorless and/or transparent state when the thermal recording material is cooled down slowly from temperature T1 according to the dashed line, or when it is heated constantly to erase temperature T2.

Figure 2:
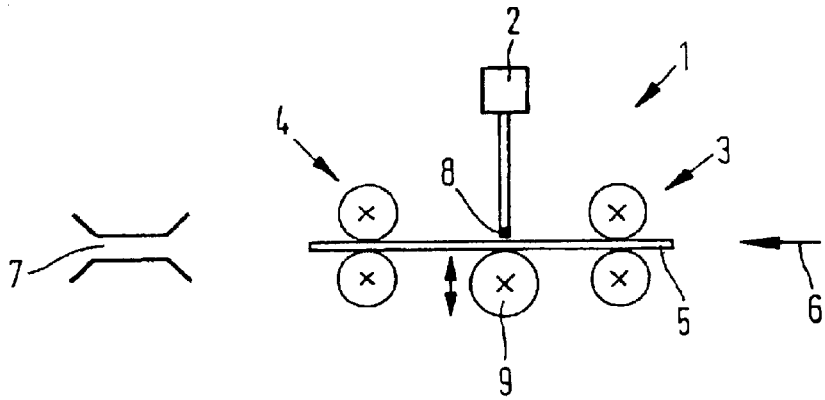
FIG. 2 shows schematically a thermal printer for reversible printing of entitlement cards.

According to FIG. 2, thermal printer 1 has thermal print head 2 between two pairs of feed rollers 3, 4. Entitlement cards 5 (one shown) are supplied according to arrow 6, moved step-by-step with feed rollers 3, 4 along thermal print head 2 for processing and outputted via output slit 7.

On its edge facing card 5, print head 2 has individually drivable resistance heating elements 8 that form on card 5 a row extending transversely to transport direction 6. Heating elements 8 are driven between two consecutive transport steps and thereby heated. Simultaneously, counterpressure roller 9 is pressed against card 5. Thus, according to the invention all heating elements 8 are first subjected to an energy pulse which causes the recording material to assume a colored/opaque state along the line. Directly thereafter, heating elements 8 are driven with an energy pulse train at the dots of the recording material or card 5 where erasure is to take place.

Figure 3:
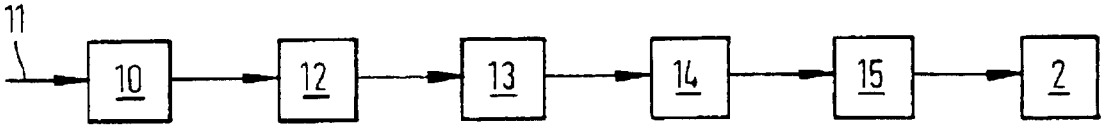
FIG. 3 shows a block diagram for driving the thermal print head.

According to FIG. 3, shift register 10 for example receives data 11 from a data source not shown for the information to be represented on card 5. Discriminator 12 distinguishes whether a colored/opaque dot or a colorless/transparent dot is to be formed on the card by relevant heating element 8 for the information recording in the particular transport step. Processing section 13 defines the data in order to generate the recording energy pulse and erase energy pulse train. The pulse data are decoded by decoder 14 into a total pulse train for driving heating elements 8 for processing the relevant line of card 5 and this total pulse train fed to driver 15.

FIG. 4 shows for the first variant of the inventive method in (a) the pulse train for driving heating elements 8 and in (b) the temperature of the thermal recording material upon reception of the pulse train.

Thus, all heating elements 8 are driven for preheating or for holding temperature T0 of for example 60° C. with pulse train P having a period of e.g. 30 microseconds and a pulse duration per period of e.g. 2 to 0.3 microseconds, depending on how great the difference is between the temperature measured by the temperature sensor (not shown) and given preheating temperature T0.

For processing a line, all heating elements 8 are subjected at t1 to recording pulse W of e.g. 1 to 2 milliseconds, causing the temperature of thermal recording material to rise at the end of the recording pulse at t2 to temperature T1 of e.g. 160° C., i.e. a temperature above the temperature at which the reversible heat-sensitive recording material assumes a colored and/or opaque state.

Heating elements 8 at the dots of the line which are to be erased are driven directly after pulse W with pulse train E1. It consists for example of single pulses with a period of 30 microseconds, whereby the pulse duration may be e.g. 10 microseconds and the pause duration for example 20 microseconds per period.

While the temperature of relevant heating element 8 decreases from T1 exponentially, i.e. rapidly, according to curve F without pulse train E1, a more linear, slower cooling takes place to preheating or starting temperature T0 according to dashed sawtooth curve S under the action of pulse train E1.

Figure 4A:
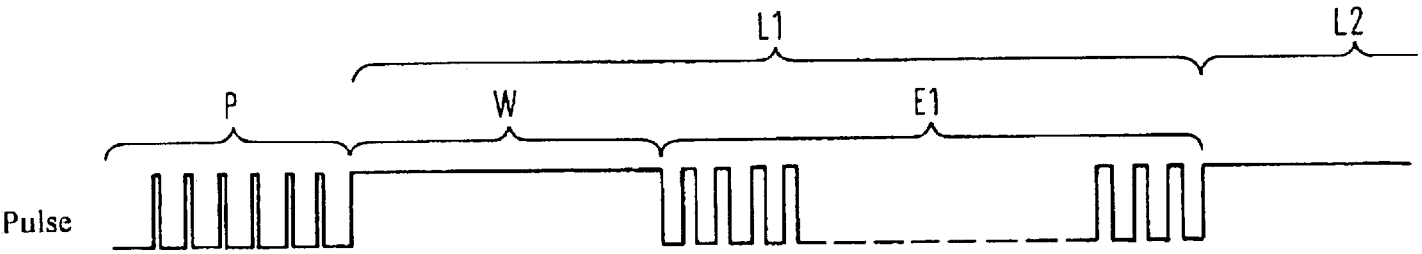
FIGS. 4 and 5 show diagrams for illustrating the first and second variants of the inventive method.
Figure 4B:
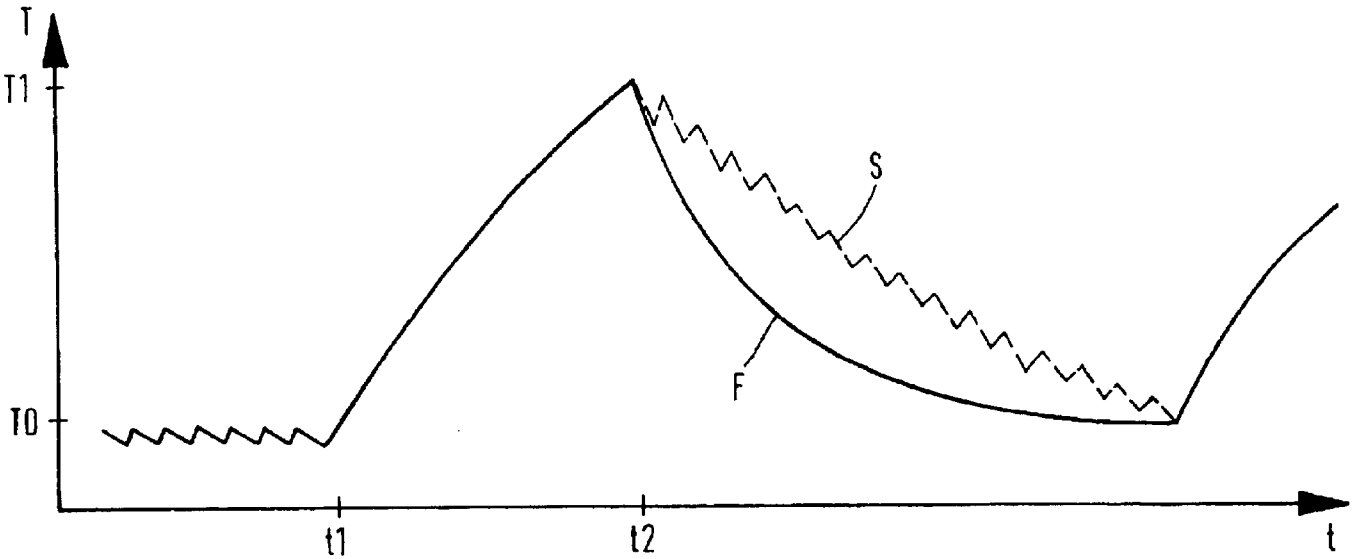

In FIGS. 4*a* and 4*b,* L1 represents the time period for processing, i.e. printing and erasing, the first line, and L2 for processing the second line.

While according to the diagram of FIG. 1 the colored/opaque state is retained through the rapid cooling according to curve F, erasure of the particular colored/opaque dot takes place through the slower, more uniform cooling according to curve S.

Figure 5A:
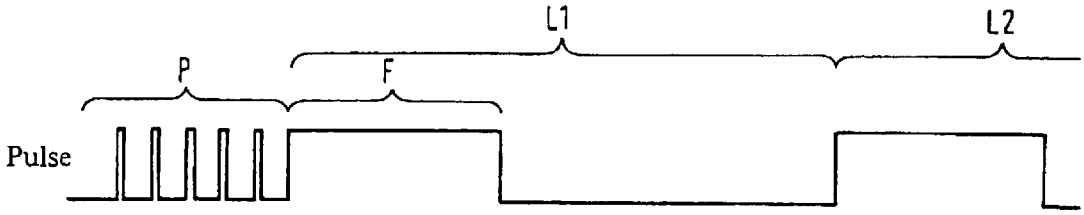
Figure 5B:
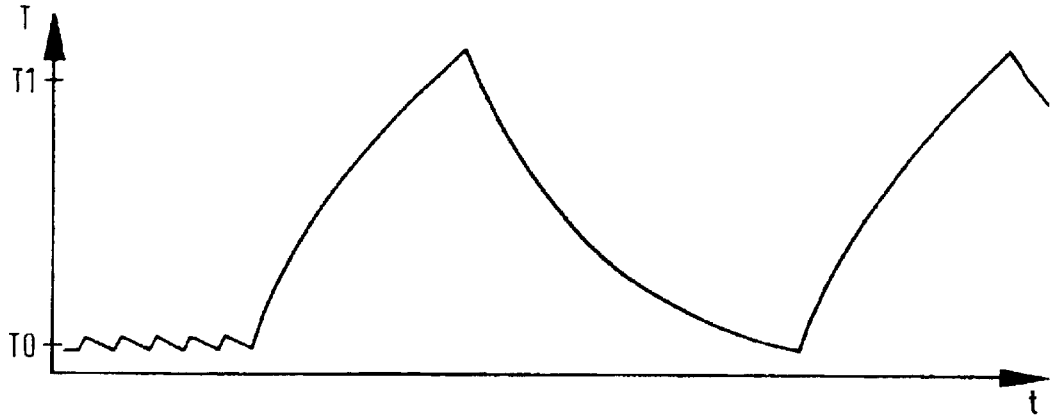
Figure 5C:
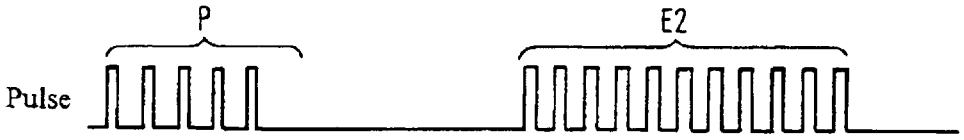
Figure 5D:
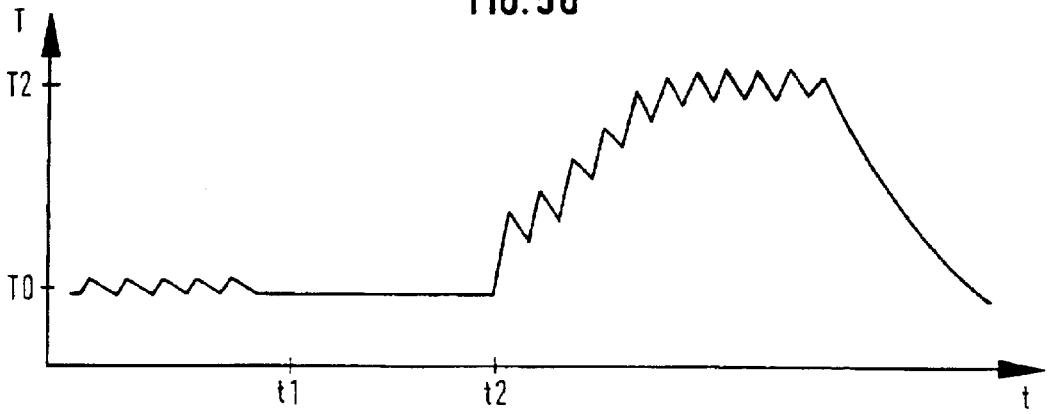

The embodiment according to FIGS. 5*a* to 5*b* differs from that according to FIGS. 4*a* and 4*b* substantially in that, directly after pulse F heating, elements 8, at the dots of the line where erasure is to be performed, a pulse train E2, which raises the temperature of the heating elements 8 according to curve C to temperature T2, is applied. FIG. 5*a* represents the pulse train supplied to the heating elements for recording, FIG. 5*c* represents the pulse train which drives the heating elements for erasure, while FIGS. 5*b* and 5*d,* respectively, represent the temperature/time diagram upon reception of pulse trains (a) and (c).

What is claimed is:

1. A method of controlling the heating elements of a thermal print head used to record and erase images on a reversibly writable thermal recording material, said method including the steps of:

applying a first set of energization pulses to the heating elements to cause the temperature of the heating elements to rise from a base temperature to a write temperature, the write temperature being a temperature at which the heating elements cause the recording material to which the heating elements are applied to turn colored or opaque;

terminating the application of the first set of energization pulses so that the temperature of the heating elements drops from the write temperature; and after said termination of the first set of energization pulses and prior to the temperature of the heating elements returning to the base temperature, applying a second set of energization pulses to the heating elements, wherein the second set of energization pulses are applied to the heating elements so that: the temperature of the heating elements falls at a rate slower than if the second set of energization pulses were not applied; and, as a result of the slowed temperature drop of said heating elements, the recording material to which the heating elements are applied cools at a rate that causes the recording material which is colored or opaque to turn transparent.

2. The method of controlling the heating elements of a thermal print head of claim 1, wherein, prior to said application of the first set of energization pulses, the heating elements are preheated to the base temperature.

3. The method of controlling the heating elements of a thermal print head of claim 2, wherein:

in said step of preheating the heating elements, a plurality of energization pulses are applied to the heating elements, the pulses having a fixed period; and in said step of applying the second set of energization pulses to the heating elements, a plurality of energization pulses are applied to the heating elements, the pulses having a fixed period, the period being the same as the period of the energization pulses applied during said step of preheating the heating elements.

4. The method of controlling the heating elements of a thermal print head of claim 3, wherein the maximum combined on and off period for each said energization pulse applied during said steps of preheating the heating elements and applying the second set of energization pulses to said heating elements is 100 microseconds.

5. The method of controlling the heating elements of a thermal print head of claim 3, wherein, during said step of applying the second set of energization pulses to said heating elements, the maximum duty cycle within each pulse during which the heating element is energized is 50% of the pulse period.

6. The method of controlling the heating elements of a thermal print head of claim 2, wherein:

after said step of applying the second set of energization pulses to said heating elements, said heating elements are heated to maintain said heating elements at the base temperature; and in said steps of preheating said heating elements and maintaining the heating elements at the base temperature, a plurality of energization pulses are applied to the heating elements wherein:

the periods of the energization pulses applied in said steps of preheating the heating elements and maintaining said heating elements at the base temperature are identical; and in said step of preheating the heating elements, during each pulse period, the heating elements are energized for a first percent duty cycle; and in said step of maintaining the heating elements at the base temperature, the heating elements are energized for a second percent duty cycle, the second percent duty cycle being less than the first percent duty cycle.

7. The method of controlling the heating elements of a thermal print head of claim 1, wherein, in said step of applying a first set of energization pulses to the heating elements, a single energization pulse is applied to the heating elements.

8. The method of controlling the heating elements of a thermal print head of claim 1, wherein, in said step of applying the second set of energization pulses to the heating elements, a plurality of energization pulses is applied to the heating elements.

9. The method of controlling the heating elements of a thermal print head of claim 8, wherein, in said step of applying the second set of energization pulses to said heating elements, the maximum duty cycle within each pulse during which the heating element is energized is 50% of the pulse period.

10. A method of recording an image on a reversibly writable thermal recording material with a thermal print heat that includes a plurality of individually energizable heating elements, said method including the steps of:

applying the recording material to the print head so the heating elements can heat the recording material;

simultaneously applying a first energization signal to the heating elements to cause the temperature of the heating elements to rise from a base temperature to a write temperature so that sections of the recording material adjacent the heating elements become colored or opaque;

terminating said application of the first energization signal to the heating elements to cause the temperature of the heating elements to drop from the write temperature;

for the heating elements associated with sections of the recording material on which the image is not to be formed, applying a second energization signal to the heating elements so that heating elements cool at a first cooling rate, the first cooling rate being a cooling rate that causes the associated sections of recording material to cool at a rate that results in the recording material turning transparent; and simultaneously with said step of applying the second energization signal to the heating elements associated with the sections of the recording material on which the image is not formed, cooling the heating elements associated with the sections of the recording medium on which the image is to be formed at a second cooling rate, the second cooling rate being greater than the first cooling rate so that the sections of the recording medium associated with the heating elements cooled at the second cooling rate remain colored or opaque.

11. The method of recording an image of claim 10, wherein, prior to said step of applying the first energization signal to the heating elements, a preheat energization signal is applied to said heating elements to preheat the heating elements to the base temperature.

12. The method of recording an image of claim 10, wherein, in said step of applying the first energization signal to the heating elements, a single energization pulse is applied to each heating element.

13. The method of recording an image of claim 10, wherein, in said step of applying the second energization signal to the heating elements, a plurality of energization pulses are applied to the heating elements.

14. The method of recording an image of claim 13, wherein, during said step of applying the second energization signal to said heating elements, the maximum duty cycle within each pulse during which the heating element is energized is 50% of the pulse period.

15. The method of recording an image of claim 10, wherein, said step of cooling the heating elements which are cooled at the second cooling rate is performed by, after said step of terminating said application of the first energization signal, not applying an additional energization signal to the heating elements.

16. A method of recording an image on a reversibly writable thermal recording material with a thermal print heat that includes a plurality of individually energizable heating elements, said method including the step of:

applying the recording material to the print head so the heating elements can heat the recording material;

simultaneously applying a first energization signal to the heating elements to cause the temperature of the heating elements to rise from a base temperature to a write temperature so that sections of the recording material adjacent the heating elements turn colored or opaque;

after said step of applying the first energization signal, for the heating elements associated with sections of the recording material on which the image is to be fixed, not energizing the heating elements so that the heating elements cool at a first cooling rate that causes the associated sections of the recording material to cool at a rate which causes the recording material to remain colored or opaque; and simultaneously with said step of cooling the heating elements associated with sections of the recording material on which the image is to be fixed, applying a second energization signal to the heating elements associated with the sections of recording medium on which the image is not fixed so that the heating elements to which the second energization signal is applied cool at a second cooling rate that is less than the first cooling rate, so that the heating elements that cool at the second cooling rate cause the associated sections of recording material to cool at a rate which results in the recording material turning transparent.

17. The method of recording an image of claim 16, wherein, prior to said step of applying the first energization signal to the heating elements, a preheat energization signal is applied to said heating elements to preheat the heating elements to the base temperature.

18. The method of recording an image of claim 16, wherein, in said step of applying the first energization signal to the heating elements, a single energization pulse is applied to each heating element.

19. The method of recording an image of claim 16, wherein, in said step of applying the second energization signal to the heating elements, a plurality of energization pulses are applied to the heating elements.

20. The method of recording an image of claim 19, wherein, during said step of applying the second energization signal, the maximum duty cycle within each pulse during which the heating element is energized is 50% of the pulse period.

* * * * *